US009597914B2

(12) United States Patent
Ogawa

(10) Patent No.: US 9,597,914 B2
(45) Date of Patent: Mar. 21, 2017

(54) INK JET RECORDING METHOD AND INK JET RECORDING APPARATUS

(71) Applicant: SEIKO EPSON CORPORATION, Tokyo (JP)

(72) Inventor: Tomohiro Ogawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/604,922

(22) Filed: Jan. 26, 2015

(65) Prior Publication Data

US 2015/0224795 A1 Aug. 13, 2015

(30) Foreign Application Priority Data

Feb. 13, 2014 (JP) ..... 2014-025131

(51) Int. Cl.
*B41J 2/43* (2006.01)
*B41M 7/00* (2006.01)
*B41M 5/00* (2006.01)

(52) U.S. Cl.
CPC ..... *B41M 7/0081* (2013.01); *B41M 5/0017* (2013.01)

(58) Field of Classification Search
CPC ..... B41J 2/435; B41J 2/44; B41J 2/447; B41J 2/21; B41J 11/0015; B41J 11/002; B41J 2/2114; B41J 2/2132; B41J 2/2135; B41J 2/43; B41J 2/425; B41M 7/0081; B41M 5/0017
USPC ..... 347/102
See application file for complete search history.

(56) References Cited

U.S. PATENT DOCUMENTS

2007/0281136 A1* 12/2007 Hampden-Smith ..... B41M 1/22 428/195.1
2009/0280302 A1 11/2009 Fukumoto et al.
2010/0182378 A1* 7/2010 Mitsuzawa ..... B41J 2/145 347/51
2010/0256283 A1 10/2010 Kagata et al.
2010/0256284 A1 10/2010 Kagata et al.
2013/0252149 A1* 9/2013 Nakamura ..... G03G 5/0609 430/56

FOREIGN PATENT DOCUMENTS

JP 2009-057548 A 3/2009
JP 2012-196893 A 10/2012
JP 2012-245676 A 12/2012
JP 2013-094734 A 5/2013
JP 20130147544 A 8/2013

* cited by examiner

*Primary Examiner* — Geoffrey Mruk
*Assistant Examiner* — Scott A Richmond
(74) *Attorney, Agent, or Firm* — Global IP Counselors, LLP

(57) ABSTRACT

An ink jet recording method includes forming an under layer by applying an active energy ray curable first ink composition which contains a metallic pigment to a printing medium, forming an intermediate layer by applying an active energy ray curable second ink composition to the under layer, and forming a first image by applying the first ink composition to the intermediate layer. In addition, it is possible to include irradiating of active energy rays onto the under layer before the forming of the intermediate layer, irradiating of active energy rays onto the intermediate layer before the forming of the first image, and irradiating of active energy rays onto the first image after the forming of the first image.

12 Claims, 2 Drawing Sheets

INK JET RECORDING METHOD AND INK JET RECORDING APPARATUS

CROSS-REFERENCE TO RELATED APPLICATIONS

This application claims priority to Japanese Patent Application No. 2014-025131 filed on Feb. 13, 2014. The entire disclosure of Japanese Patent Application No. 2014-025131 is hereby incorporated herein by reference.

BACKGROUND

Technical Field

The present invention relates to an ink jet recording method and an ink jet recording apparatus.

Related Art

In the prior art, metal plating, foil press printing where a metal foil is used, thermal transfer where a metal foil is used, and the like are used as a method for manufacturing an ornament which has a glossy outer appearance. However, there is a problem with these methods in that forming a delicate pattern or applying a pattern onto a curved section is difficult. In addition, there is a problem in that it is necessary to prepare foil with a certain tone in advance in foil press printing since it is not possible to arbitrarily print metal with a tone such as gradation. In addition, superior gloss is possible but it is difficult to form a high level design where there are delicate hairlines and minute concavities and convexities in a case where metal plating, foil press printing where a metal foil is used, thermal transfer where a metal foil is used, or the like are used.

With regard to this problem, a method for recording using an ink jet system is used as a method for recording onto a recording medium using a composition which includes a pigment or a dye. The ink jet system has a characteristic in that it is possible to arrange ink measured in microns at an arbitrary location with an arbitrary amount and is superior in terms of a feature where it is possible to appropriately apply the ink jet system also to forming of delicate patterns and recording onto a curved surface section, a feature where it is possible to print only a specific part on demand, and a feature where it is possible to print with gradations. For this reason, there is trialing in recent years where an ink composition, which includes a metallic powder as a pigment, is applied to an ink jet system. For example, an ink jet recording method is described in Japanese Unexamined Patent Application Publication No. 2012-196893 where a luminescent layer which consists of luminescent pigment ink is formed on an under layer which consists of resin ink in order to improve gloss or adhesiveness of an image.

Furthermore, it is possible to use an ink composition which is cured by irradiating ultraviolet rays or the like (an ultraviolet curable ink composition) in the ink jet system in order for scratch resistance, water resistance, solvent resistance, and the like to be particularly superior (for example, refer to Japanese Unexamined Patent Application Publication No. 2009-57548). As a method for recording where a light curable ink composition is used for ink jet recording in this manner, it is disclosed in Japanese Unexamined Patent Application Publication No. 2013-94734 that an image, where color irregularities, streaks, and the like are reduced, is obtained by performing recording where images, where the ink composition is used, are layered.

Furthermore, in recent years, use of metallic powder as a pigment is investigated in order to realize a metallic color using an ultraviolet curable ink composition for ink jet recording in this manner (refer to Japanese Unexamined Patent Application Publication No. 2013-147544). As a method for recording where an ultraviolet curable ink composition for ink jet recording, which contains a metallic powder (metallic pigment), is used in this manner, it is disclosed in, for example, in Japanese Unexamined Patent Application Publication No. 2012-245676 that an ink receiving layer is formed between an ultraviolet curable metallic ink and a base material in order to improve brightness of an image which is obtained using metallic ink.

SUMMARY

It is obvious that expression of not only the magnitude of gloss (metallic gloss) of an image which is obtained but also of various designs are demanded in a case where an image is formed using an ultraviolet curable ink composition for ink jet recording which contains a metallic pigment as described above. As these designs, there are the examples of mirror surface finishing with high gloss, surface processing using delicate patterns (micro concavities and convexities within an image), a large pattern of concavities and convexities within an image (embossing processing), and the like, and a printing technique is necessary in order to widely express using basically one ink.

However, it is difficult to perform expressions of various designs without the conditions being clear for realizing a high level design (for example, mirror surface finishing, surface processing, or embossing processing) where an ultraviolet curable ink composition for ink jet recording is used.

In order for ink to be effectively and quickly cured onto the base material (the recording medium) which is used in an ultraviolet ray curable ink jet system, a base material which has little or almost no ink absorbency is typically used since there is a necessity for ink to remain on the base material.

Here, the diameter of ink liquid droplets which are discharged in the ink jet system is tens of micrometers. For this reason, immediately after being arranged on the base material, the ink droplets have concavities and convexities of tens of micrometers before wetting and spreading. In a case where ultraviolet rays are irradiated in this state (which is immediately after landing of liquid droplets), liquid droplets are cured in a state of having concavities and convexities without any changes and a printing material which has graininess is obtained, but sufficient time is not obtained for orientating the metallic pigment on a gas-liquid interface. As a result, there is a tendency for extremely poor gloss without it being possible to realize smooth alignment of the metallic pigment or uniform reflection of light which accompanies smooth alignment of the metallic pigment due to considerable metallic pigment remaining at the inner sections of liquid droplets. On the other hand, there are also extremely poor gloss due to the same reason in a case where there is an attempt to express embossing by liquid droplets being simply accumulated. In addition, it is easy for irregularities in metallic pigment to be generated since fluidity of the metallic pigment is lower than the fluidity of liquid droplets in a case where the ink composition is left without any changes for a while after landing of the liquid droplets, and it is difficult to simply perform mirror surface finishing on only one layer since concavities and convexities are generated as a result of curing which is not uniform.

Several aspects according to the present invention solve at least a portion of the problems described above and provide an ink jet recording method and an ink jet recording apparatus where it is possible to express various types of metallic gloss and it is possible to form an embossed image which has metallic gloss.

The present invention is carried out in order to solve at least a portion of the problems described above and is able to be realized as the following aspects or examples.

An aspect of an ink jet recording method includes forming an under layer by applying an active energy ray curable first ink composition which contains a metallic pigment to a printing medium, forming an intermediate layer by applying an active energy ray curable second ink composition to the under layer, and forming a first image by applying the first ink composition to the intermediate layer.

According to the aspect described above, it is possible to express various types of metallic gloss and it is possible to form an embossed image which has metallic gloss.

In the aspect described above, it is possible for the thickness of the intermediate layer to be equal to or more than 50 μm and equal to or less than 300 μm.

In the aspect described above, it is possible for the forming of the first image to further include forming a second image by applying the first ink composition to a region where the intermediate layer is not formed.

In the aspect described above, the mass of the second ink composition, which is used in order to form the intermediate layer, applied per unit of area may be larger than the mass of the first ink composition, which is used in order to form the under layer, applied per unit of area.

In the aspect described above, it is possible for the second ink composition to be a color ink composition which contains a colorant or a clear ink composition which substantially does not contain a colorant.

The ink jet recording method according to the aspect described above further includes performing a first irradiating process to irradiate active energy rays onto the under layer before the forming of the intermediate layer, and performing a second irradiating process to irradiate active energy rays onto the intermediate layer before the forming of the first image, where it is possible to irradiate active energy rays within one second since liquid droplets of the first ink composition which forms the under layer land on the recording medium in the first irradiating process and to irradiate active energy rays within one second since liquid droplets of the second ink composition which forms the intermediate layer land on the under layer in the second irradiating process.

The ink jet recording method according to the aspect described above further includes performing a third irradiating process to irradiate active energy rays onto the first image after the forming of the first image, where it is possible to irradiate active energy rays after one second elapses since liquid droplets of the first ink composition which forms the first image land on the intermediate layer in the third irradiating process.

In the aspect described above, it is possible for the mass of the first ink composition, which is used in order to form the first image, applied per unit of area to exceed 80% and be equal to or less than 200% in a case where the mass of the second ink composition, which is used in order to form the intermediate layer, applied per unit of area is 100%.

In the aspect described above, it is possible for the mass of the first ink composition, which is used in order to form the first image, applied per unit of area to be equal to or more than 10% and equal to or less than 80% in a case where the mass of the second ink composition, which is used in order to form the intermediate layer, applied per unit of area is 100%.

An aspect of an ink jet recording apparatus executes the ink jet recording method according to the aspect described above.

The ink jet recording apparatus according to the aspect described above may include a control section which executes a plurality of modes, and in a case where the mass of the second ink composition, which is used in order to form the intermediate layer, applied per unit of area is 100%, the plurality of modes may include a first mass mode where the mass of the first ink composition, which is used in order to form the first image, applied per unit of area exceeds 80% and is equal to or less than 200%, and a second mass mode where the mass of the first ink composition, which is used in order to form the first image, applied per unit of area is equal to or more than 10% and equal to or less than 80%, and the control section may execute switching between the first mass mode and the second mass mode.

The ink jet recording apparatus according to the aspect described above may include a control section which executes a plurality of modes, and in a case where active energy rays are irradiated with regard to the first image after the forming of the first image, the plurality of modes may include a first irradiating mode where active energy rays are irradiated within one second since liquid droplets of the first ink composition which forms the first image land on the intermediate layer, and a second irradiating mode where active energy rays are irradiated after one second elapses since liquid droplets of the first ink composition which forms the first image land on the intermediate layer, and the control section may execute switching between the first irradiating mode and the second irradiating mode.

BRIEF DESCRIPTION OF THE DRAWINGS

Referring now to the attached drawings which form a part of this original

DISCLOSURE

Figure 1:
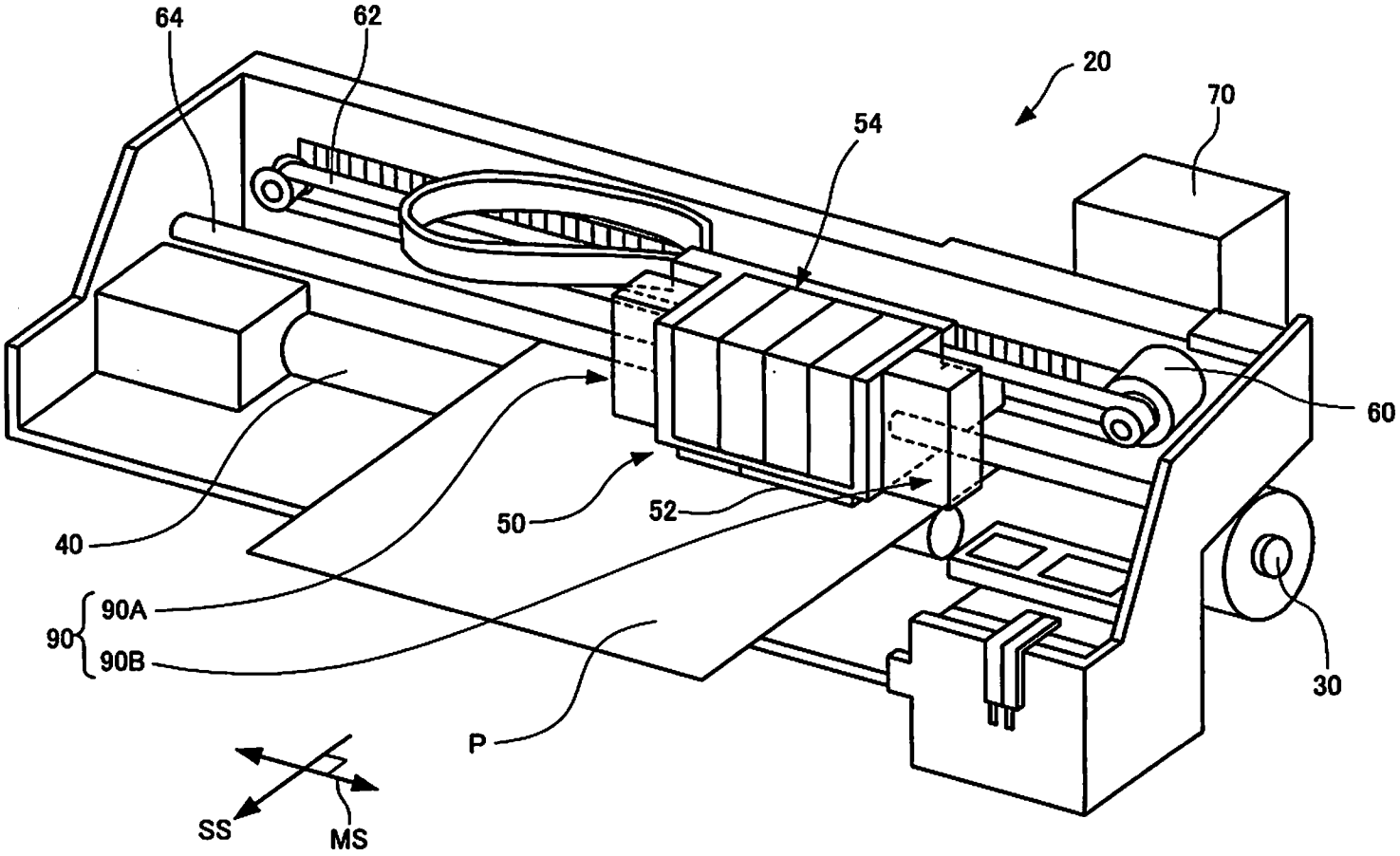

FIG. 1 is a diagram schematically illustrating a recording apparatus where it is possible to use an ink jet recording method according to an embodiment of the present invention.

Figure 2:
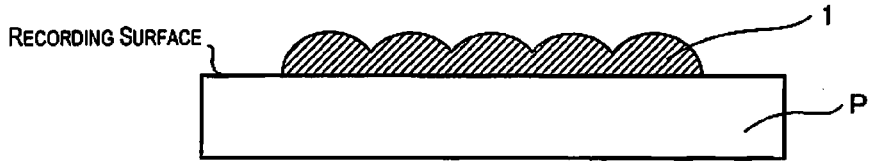

FIG. 2 is a diagram schematically illustrating a side surface of an under layer which is obtained in an under layer forming process in an ink jet recording method according to an embodiment of the present invention.

Figure 3:
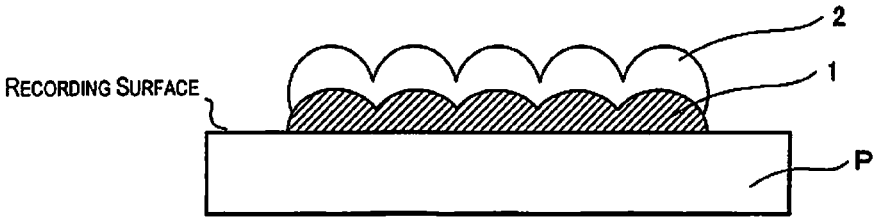

FIG. 3 is a diagram schematically illustrating a side surface of an under layer and an intermediate layer after an intermediate layer forming process in an ink jet recording method according to an embodiment of the present invention.

Figure 4:
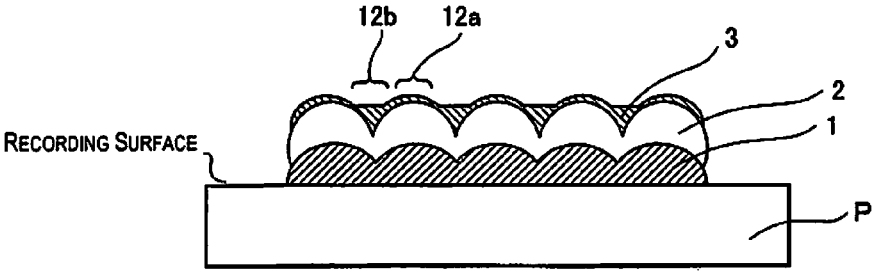

FIG. 4 is a side surface diagram schematically illustrating a case where a first image, which is obtained using an ink jet recording method according to an embodiment of the present invention, has sheen.

Figure 5:
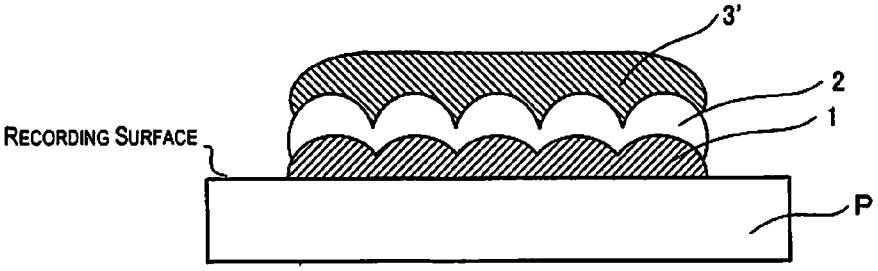

FIG. 5 is a side surface diagram schematically illustrating a case where a first image, which is obtained using an ink jet recording method according to an embodiment of the present invention, has mirror surface gloss.

DETAILED DESCRIPTION OF EXEMPLARY EMBODIMENTS

Appropriate embodiments of the present invention will be described below. The embodiments described below describe examples of the present invention. In addition, the present invention is not limited to the embodiments below and includes various modified examples which are carried out within the range such that the gist of the present invention is not modified. Here, it is not necessarily the case that all of the configurations which are described below in the embodiments are essential configuration elements of the present invention.

1. Ink Jet Recording Method

An ink jet recording method according to an embodiment of the present invention includes an under layer forming process for forming an under layer by applying an active energy ray curable first ink composition which contains a metallic pigment to a printing medium, an intermediate layer forming process for forming an intermediate layer by applying an active energy ray curable second ink composition to the under layer, and an image forming process for forming a first image by applying the first ink composition to the intermediate layer.

The apparatus configuration of an ink jet recording apparatus where it is possible to use the ink jet recording method according to the present embodiment and each process of the ink jet recording method will be described below in order.

1.1. Apparatus Configuration

The apparatus configuration of the ink jet recording apparatus where it is possible to use the ink jet recording method according to the present embodiment is described with reference to the drawings. Here, there are cases where the dimensions are appropriately modified in order for it to be easy to understand the structure of the ink jet recording apparatus according to the present embodiment.

FIG. 1 is a perspective diagram schematically illustrating an ink jet printer 20 (referred to below simply as "printer 20") which is an example of the ink jet recording apparatus according to the present embodiment.

The printer 20 shown in FIG. 1 is provided with a motor 30 which sends a recording medium P in a transport direction SS, a platen 40, a carriage 50, and a carriage motor 60 which moves the carriage 50 in a main scanning direction MS.

The carriage 50 is pulled using a traction belt 62 which is driven by the carriage motor 60 and moves along a guide rail 64.

As shown in FIG. 1, the printer 20 is a serial type of printer where a head 52 is mounted in the carriage 50. The serial type of printer moves the head 52 along the main scanning direction MS in accompaniment with movement of the carriage 50 in the main scanning direction MS. In addition, the recording medium P is moved in the transport direction SS due to the platen 40 being operated by driving of the motor 30. Due to this, it is possible for active energy ray curable ink compositions to be adhered to the recording medium P at positions which are different.

The head 52 adheres the active energy ray curable ink compositions (the first ink composition and the second ink composition which will be described later) onto the recording medium P due to the ink compositions being discharged from nozzle holes (which are not shown in the drawings) as liquid droplets with extremely small particle diameters. The head 52 is not particularly limited as long as there are the functions described above and any recording method may be used. As the recording method for the head 52, there are the examples of, for example, a method where a strong electric field is applied between a nozzle and an acceleration electrode which is placed in front of the nozzle, ink is continuously discharged from the nozzle in liquid droplet form, and recording is carried out by applying a printing information signal to deflecting electrodes while ink droplets travel through air between the deflecting electrodes, a method (an electrostatic suction method) where ink droplets are discharged to correspond to a printing information signal without the ink droplets being deflected, a method where pressure is applied to ink liquid using a small pump and the ink droplets are forcibly discharged by the nozzle being mechanically vibrated using a crystal oscillation element or the like, a method (a piezo method) where pressure is applied to ink liquid using a piezoelectric element at the same time as a printing information signal and recording is carried out by discharging ink droplets, a method (a thermal jetting method) where ink liquid is thermally expanded using a micro-electrode in accordance with a printing information signal and recording is carried out by discharging ink droplets, and the like.

Four ink cartridges 54 are independently mounted in the carriage 50 where the head 52 is mounted and the first ink composition or the second ink composition are filled into any of the four ink cartridges. The number of cartridges is four in the example in FIG. 1 but the number of cartridges is not limited to being four and it is possible for a desired number of cartridges to be mounted. In addition, the ink cartridges 54 are not limited to being mounted in the carriage 50 as shown in FIG. 1, and may be substituted with, for example, a type which is mounted on a case body side of the printer 20 and where ink is supplied to the head 52 through an ink supply tube.

The printer 20 according to the present embodiment is provided with a first light source 90 as an irradiating unit. The first light source 90 irradiates active energy rays with regard to liquid droplets which are applied to the recording medium P using the head 52. The first light source 90 consists of first light sources 90A and 90B which are provided at the ends on both sides of the head 52 in the main scanning direction MS in the example in FIG. 1. One each of the first light sources is arranged on each side of the one head in the example in FIG. 1, but two or more of the first light sources may be arranged on each side of the head.

The shape of the first light source 90 is not particularly limited and the shape of the first light source 90 is not particularly limited as long as the shape is a shape where it is possible to irradiate active energy rays onto liquid droplets of the ink composition which lands on the recording medium P by being discharged from the nozzles in the head 52 due to the carriage 50 being moved one time. In addition, it is possible to arbitrarily set the distance between the first light source 90 and the recording medium P by taking into consideration the strength and the time for irradiating or the like of active energy rays which are irradiated.

It is possible to use a mercury lamp, a metal halide lamp, an LED (a Light Emitting Diode), an LD (a Laser Diode), or the like as the first light source 90, but it is preferable to use an LED or an LD from the point of achieving a reduction in size of the apparatus and a reduction in power consumption.

In addition, it is possible for the wavelength of active energy rays which are emitted to be in the range of, for example, approximately 350 nm to 430 nm in a case where an LED or an LD is used as the light source.

The printer 20 may be provided with a second light source which is not shown in the drawings. It is possible for the second light source to further cure liquid droplets which are adhered to the recording medium. The second light source may be mounted in the carriage 50 and may be provided more to the transport direction SS side of the recording medium P than the head 52. In addition, the second light source may be mounted in the carriage and may be arranged at a position on the opposite side to the head 52 with regard to the first light source 90. In addition, without being mounted in the carriage 50, the second light source may be provided to be fixed at the transport direction SS side of the recording medium P. In this manner, the arrangement position of the second light source is not particularly limited as long as the second light source is provided at a position where it is possible to irradiate active energy again with regard to liquid droplets where active energy rays are irradiated using the first light source 90.

It is preferable that the second light source use either an LED or an LD due to the same reasons as with the first light source 90. It is possible for the wavelength of active energy rays which are emitted to be in the range of, for example, approximately 350 nm to 430 nm in a case where an LED or an LD is used as the light source. In addition, the wavelengths which are emitted from each of the light sources may be the same or may be different in a case where there are a plurality of second light sources.

The printer 20 shown in FIG. 1 is provided with a control section 70. The control section 70 is configured by utilizing, for example, a computer which has a CPU and a memory. It is possible for the control section 70 to move the carriage 50, discharge from the head 52, set the strength and time for irradiating of active energy rays from the first light source 90, and perform operation control of the motor 30 or the like which sends the recording medium P in the transport direction SS due to various commands being executed.

It is possible for the control section 70 to have a command information receiving unit which receives command information. The command information is output based on operating of an operation receiving unit (for example, a touch panel or an operation button which is provided on the printer 20, a keyboard of a PC or the like which is connected to the printer 20, or the like) by a user and is received by the command information receiving unit. In addition, as the command information, it is possible for there to be the examples of, for example, an image recording command where a designated image is formed by executing each process which will be described later, a first mode executing command for executing a first mass mode which will be described later, a second mode executing command for executing a second mass mode which will be described later, a first irradiating mode executing command for executing a first irradiating mode, a second irradiating mode executing command for executing a second irradiating mode, and the like.

It is possible for the control section 70 to have a command executing unit which receives command information which is output from the command information receiving unit and performs an executing operation. It is possible for the command executing unit to perform an executing operation where an executing timing and the like of each operation of the carriage 50, the head 52, the first light source 90, the motor 30, or the like described above is controlled and coordinated.

The description is centered on a serial head type of printer (the recording apparatus) as described above, but the present invention is not limited to this aspect. In detail, the recording apparatus may be a line head type of printer where the recording heads are fixed and arranged in order in the sub-scanning direction, or a lateral type of printer which is provided with a head (a carriage) which is provided with a moving mechanism which moves in the X direction and the Y direction (the main scanning direction and the sub-scanning direction) as described in Japanese Unexamined Patent Application Publication No. 2002-225255. The Sure-Press L-4033A (manufactured by Seiko Epson Corp.) is an example of a lateral type of printer.

1.2. Processes

An ink jet recording method according to the present embodiment is provided with the under layer forming process, the intermediate layer forming process, and the image forming process. Each of the processes will be described below in detail.

1.2.1. Under Layer Forming Process

The under layer forming process is a process for forming an under layer by applying the active energy ray curable first ink composition (which will be described later) which contains a metallic pigment to the recording medium. In detail, the under layer is formed on the recording medium by adhering liquid droplets of the first ink composition which are discharged from the nozzles in the head 52 onto a prearranged region where the first image is to be formed on the recording medium P.

The under layer functions as a platform (a filling layer) which suppresses excessive wetting and spreading of the intermediate layer and the first image which are formed on the under layer. In addition, the under layer is provided with a function where metallic gloss, which is generated using the first image, is improved since the under layer is formed using the first ink composition which contains a metallic pigment.

Here, "metallic gloss" in the present specification is a concept which includes mirror surface gloss (hereafter also referred to as "shine") and sheen (hereinafter also referred to as "luster"). Mirror surface gloss (shine) is generated in a case where the degree of mirror surface reflection is large and is favorably manifested in a case where the front surface of the image, which is recorded using ink which contains a metallic pigment, is substantially flat. On the other hand, sheen (luster) is generated in a case where the degree of diffuse reflection is large and is favorably manifested in a case where high-gloss regions and low-gloss regions are mixed in one image which is recorded using ink which contains a metallic pigment.

FIG. 2 is a diagram schematically illustrating a side surface of an under layer 1 which is obtained in the under layer forming process and illustrates a state where the front surface of the under layer remains in a state of having graininess. It is possible for the graininess in the front surface of the under layer to be obtained by suppressing excessive wetting and spreading of the under layer (liquid droplets which configure the under layer), and it is possible to generate the graininess due to liquid droplets which are adhered to the recording medium remaining on the recording medium without any changes substantially holding their shape. In this manner, when the front surface of the under layer has graininess, it is easy to obtain an image which has a wide range of metallic gloss from sheen to mirror surface gloss by controlling the conditions (applied mass and timing for irradiating active energy rays) when forming the first image.

It is possible to appropriately set the mass of the first ink composition, which is used in order to form the under layer, applied per unit of area according to the type of recording medium, but the mass applied per unit of area is preferably equal to or more than 2 $g/m^2$ and equal to or less than 20 $g/m^2$, is more preferably equal to or more than 3 $g/m^2$ and equal to or less than 18 $g/m^2$, and is even more preferably equal to or more than 5 $g/m^2$ and equal to or less than 16 $g/m^2$. It is possible for the under layer to be formed in a desired shape and the function of the under layer as the platform is further enhanced by the mass applied per unit of area being equal to or more than 2 $g/m^2$. In addition, it is easy to maintain the state where the front surface of the under layer is provided with graininess since it is possible to suppress excessive wetting and spreading of the under layer by the mass applied per unit of area being equal to or less than 20 $g/m^2$. Furthermore, since it is possible to suppress bleeding at outer peripheral sections (contour portions) of the under layer when wetting and spreading of the under layer is suppressed, the first image, which is recorded after the under layer, is sharp.

Here, the mass applied per unit of area in the present specification is determined by dividing the total discharge amount (the mass before drying) of the ink composition, which is discharged in order to form a designated layer (an image), by the area of the layer (the image) which is formed.

The discharge amount per single droplet of the liquid droplets of the first ink composition, which are discharged in order to form the under layer, is preferably equal to or more than 3 ng and equal to or less than 20 ng, is more preferably equal to or more than 5 ng and equal to or less than 20 ng, and is even more preferably equal to or more than 7 ng and equal to or less than 20 ng. It is possible to improve recording speed in forming of the under layer by the discharge amount being equal to or more than 3 ng. The function as a platform is favorably exhibited by the discharge amount being equal to or less than 20 ng since it is easy for the under layer to be a desired shape. Furthermore, it is possible to suppress bleeding at outer peripheral portions (contour portions) of the under layer and it is easy to maintain the state where the front surface of the under layer is provided with graininess since it is possible to suppress excessive wetting and spreading of liquid droplets by the discharge amount being equal to or less than 20 ng.

The thickness of the under layer is preferably equal to or more than 10 μm and equal to or less than 100 μm and is more preferably equal to or more than 20 μm and equal to or less than 80 μm. There is a tendency for the function of the under layer as the platform to be further favorably exhibited by the thickness of the under layer being within the range described above. The thickness of the under layer is determined using a method such as measuring the level difference or the like with the recording medium (SURFTEST SV-600 manufactured by Mitsutoyo Corp.).

It is preferable that the ink jet recording method according to the present embodiment be further provided with a first irradiating process. The first irradiating process is a process, where active energy rays are irradiated onto the under layer before the intermediate layer forming process which will be described later, and is performed using, for example, the first light source described above. Due to this, it is possible to cure liquid droplets of the first ink composition which configures the under layer.

It is preferable to perform irradiating of active energy rays in the first irradiating process within one second (preferably equal to or more than 0.001 seconds and equal to or less than 1 second, more preferably equal to or more than 0.005 seconds and equal to or less than 0.8 seconds, and even more preferably equal to or more than 0.008 seconds and equal to or less than 0.5 seconds) since liquid droplets of the first ink composition which forms the under layer land on the recording medium. By irradiating active energy rays within one second since the liquid droplets land in this manner, it is possible to suppress excessive wetting and spreading of the liquid droplets of the first ink composition which configures the under layer, it is possible to suppress bleeding at outer peripheral portions (deep portions) of the under layer, and it is possible to cure without any changes to the state where the front surface of the under layer is provided with graininess. Here, "landing" in the present specification refers to when the liquid droplets which are discharged come into contact with the recording medium.

It is preferable that the first ink composition contain a polymerizable compound in the manner which will be described later. In this case, the time from starting irradiating of active energy rays onto liquid droplets until the degree of curing of the polymerizable composition, which is included in the liquid droplets of the first ink composition, reaches 90% is preferably equal to or less than 0.5 seconds, is more preferably equal to or less than 0.3 seconds, and is even more preferable equal to or less than 0.2 seconds from the point of view that it is possible to suppress the shape of the under layer from unintentionally changing. Here, it is possible to perform measuring of the degree of curing using, for example, various apparatuses such as a differential scanning calorimeter DSC-60 (product name, manufactured by Shimadzu Corp.).

The recording medium which is used in the ink jet recording method according to the present embodiment may be any material, either absorptive or non-absorptive materials may be used, and it is possible to use natural fibers and synthetic fibers such as, for example, paper (normal paper, specialized ink jet paper, and the like), plastic materials, metal, ceramic, wood, shells, cotton, polyester, and wool, non-woven fabric, and the like as the recording medium, but it is preferable that at least the front surface (a portion where the ink composition is applied) be configured by a non-absorptive material (for example, plastic materials, metal, ceramic, shells, or the like). Due to this, it is possible to more appropriately perform controlling of the shape of the ink composition in a case where a non-absorptive (a non-liquid-absorbing) material is used as the recording medium. Here, a non-absorptive recording medium in the present invention refers to, for example, a recording medium where ink is not absorbed substantially and the angle of contact of liquid droplets after landing does not become, for example, 10 degrees or less (except in a case where the angle of contact is reduced due to evaporation of a liquid medium).

1.2.2. Intermediate Layer Forming Process

The intermediate layer forming process is a process for forming the intermediate layer by applying the active energy ray curable second ink composition (which will be described later) to the under layer. In detail, the intermediate layer is formed on the under layer by adhering liquid droplets of the second ink composition which are discharged from the nozzles in the head 52 in the region where the under layer is formed.

The intermediate layer is provided with a function as a platform (a filling layer) of the first image and a function where an embossing pattern is applied. Here, the embossing pattern is generated using the height difference between the first image which is formed on the intermediate layer and a portion where the intermediate layer is not formed. According to the ink jet recording method according to the present embodiment, it is possible to form an embossed image which has metallic gloss (sheen or mirror surface gloss).

Here, as the "portion where the intermediate layer is not formed", there are the examples of the front surface of the recording medium where the under layer is not formed, the front surface of the under layer where the intermediate layer is not formed, and the like.

FIG. 3 is a diagram schematically illustrating a side surface of an under layer 1 and an intermediate layer 2 after the intermediate layer forming process and illustrates a state where the front surface of the intermediate layer remains in a state of having graininess. It is possible for the graininess in the front surface of the intermediate layer to be obtained by suppressing excessive wetting and spreading of the intermediate layer (liquid droplets which configure the intermediate layer), and it is possible to generate the graininess due to the liquid droplets, which are adhered to the recording medium, remaining on the under layer without any changes substantially holding their shape. In this manner, when the front surface of the intermediate layer has graininess, the function of the first image as a platform and the function of applying embossing are increased and it is easy to obtain an image which has a wide range of metallic gloss from sheen to mirror surface gloss by controlling the conditions (applied mass and timing for irradiating active energy rays) when forming the first image.

It is preferable that the mass of the second ink composition, which is used in order to form the intermediate layer, applied per unit of area be large with regard to the mass of the first ink composition, which is used in order to form the under layer, applied per unit of area (that is, the mass of the second ink composition exceeds the mass of the first ink composition), it is more preferable that the mass of the second ink composition be at least as large as the mass of the first ink composition and the mass of the second ink composition be up to five times as large as the mass of the first ink composition, and it is even more preferable that the mass of the second ink composition be at least one and a half times as large as the mass of the first ink composition and the mass of the second ink composition be up to three times as large as the mass of the first ink composition. It is possible to favorably express embossing since the thickness of the intermediate layer is sufficient by the mass of the second ink composition exceeding the mass of the first ink composition. In addition, it is possible to form a precise pattern since it is possible to suppress excessive wetting and spreading of liquid droplets of the second ink composition which configures the intermediate layer by the mass of the second ink composition being up to five times as large the mass of the first ink composition.

The mass of the second ink composition, which is used in order to form the intermediate layer, applied per unit of area is preferably equal to or more than 3 $g/m^2$ and equal to or less than 60 $g/m^2$, is more preferably equal to or more than 4 $g/m^2$ and equal to or less than 50 $g/m^2$, and is even more preferably equal to or more than 5 $g/m^2$ and equal to or less than 40 $g/m^2$. It is possible to favorably express embossing since the thickness of the intermediate layer is sufficient by the mass applied per unit of area being equal to or more than 3 $g/m^2$. In addition, it is possible to form a precise pattern since it is possible to suppress excessive wetting and spreading of the second ink composition which configures the intermediate layer by the mass applied per unit of area being equal to or less than 60 $g/m^2$.

The discharge amount per single droplet of the liquid droplets of the second ink composition, which are discharged in order to form the intermediate layer, is preferably equal to or more than 3 ng and equal to or less than 20 ng, is more preferably equal to or more than 5 ng and equal to or less than 20 ng, and is even more preferably equal to or more than 7 ng and equal to or less than 20 ng. It is possible to improve recording speed in forming of the intermediate layer by the discharge amount being equal to or more than 3 ng. It is possible to form a precise pattern since it is possible to suppress excessively wetting and spreading of the second ink composition due to the discharge amount being equal to or less than 20 ng.

The thickness of the intermediate layer is preferably equal to or more than 50 μm and equal to or less than 300 μm and more preferably equal to or more than 70 μm and equal to or less than 200 μm. It is possible to favorably express embossing by the thickness of the intermediate layer being equal to or more than 50 μm, and it is possible to form a precise pattern when the thickness of intermediate layer is equal to or less than 300 μm. Here, there is a tendency for a further effect where embossing is improved to be unrecognizable in a case where the thickness of the intermediate layer exceeds 300 μm. It is possible for the thickness of the intermediate layer to be measured using the same method as the thickness of the under layer.

The intermediate layer may consist of a plurality of unit layers. In this case, the intermediate layer is formed by layering the plurality of unit layers which are formed using the second ink composition. It is possible to further increase the height difference between the concavities and convexities in the intermediate layer when the intermediate layer is formed from the plurality of unit layers. In this case, it is even easier to obtain an image which has a wide range of metallic gloss from sheen to mirror surface gloss by controlling the conditions (applied mass or timing for irradiating of active energy rays) when forming the first image.

It is preferable that the ink jet recording method according to the present embodiment be further provided with a second irradiating process. The second irradiating process is a process, where active energy rays are irradiated onto the intermediate layer before the image forming process which will be described later, and is performed using, for example, the first light source described above. Due to this, it is possible to cure liquid droplets of the second ink composition which configures the intermediate layer.

It is preferable to perform irradiating of active energy rays in the second irradiating process within one second (preferably equal to or more than 0.001 seconds and equal to or less than 1 second, more preferably equal to or more than 0.005 seconds and equal to or less than 0.8 seconds, and even more preferably equal to or more than 0.008 seconds and equal to or less than 0.5 seconds) since liquid droplets of the second ink composition which forms the intermediate layer land on the recording medium. By irradiating active energy rays within one second since the liquid droplets land in this manner, it is possible to suppress excessive wetting and spreading of liquid droplets of the second ink composition which configures the intermediate layer and it is possible to from a precise pattern.

It is preferable that the second ink composition contain a polymerizable compound in the manner which will be described later. In this case, the time from starting irradiating of active energy rays onto liquid droplets until the degree of curing of the polymerizable composition, which is included in liquid droplets of the second ink composition, reaches 90% is preferably equal to or less than 0.5 seconds, is more preferably equal to or less than 0.3 seconds, and is even more preferably equal to or less than 0.2 seconds from the point of view that it is possible to suppress the shape of the intermediate layer from unintentionally changing. Here, it is possible to perform measuring of the degree of curing using the apparatus which is shown with regard to the under layer.

1.2.3. Image Forming Process

The image forming process is a process for forming the first image by applying the active energy ray curable first ink composition which contains a metallic pigment (which will be described later) to the intermediate layer. In detail, the first image is formed on the intermediate layer by adhering liquid droplets of the first ink composition which are discharged from the head 52 in the region where the intermediate layer is formed. By doing this, recording material, where an image is formed on the recording medium, is obtained. It is possible to provide recording material which is obtained using the ink jet recording method according to the present embodiment with both designs of metallic gloss (sheen or mirror surface gloss) which is derived from the first image and the under layer and embossing which is derived from the intermediate layer.

FIG. 4 is a side surface diagram schematically illustrating a case where the first image has sheen. In FIG. 4, the under layer 1, the intermediate layer 2, and a first image 3 are layered in order on the recording medium P. Convex regions 12*a* and convex regions 12*h* are formed on the front surface of the first image 3. In this case, gloss is high in the convex regions 12*a* due to an image with a metallic pigment being thick and smoothly aligned. On the other hand, gloss is low in the concave regions 12*b* due to an image with a metallic pigment being thin and not smoothly aligned in the first image 3. In addition, as a consideration into the reason why the gloss in the concave regions 12*b* is sensed as being different to the gloss in the convex regions 12*a*, there is a feature where the influence of the metallic pigment in the under layer 1 is received due to the thickness of the first image 3 being thin. Due to this, the entirety of the first image 3 has sheen. That is, it is important to form the first image 3 under the condition that depressions, which are formed due to the under layer 1 and the intermediate layer 2, are not lost.

FIG. 5 is a side surface diagram schematically illustrating a case where the first image has mirror surface gloss. In FIG. 5, the under layer 1, the intermediate layer 2, and a first image 3' are layered in order on the recording medium P. In FIG. 5, the front surface of the first image 3' has a shape which is substantially flat. In order for the front surface of the first image to have a shape which is substantially flat in this manner, the first image 3' is obtained by being formed under the condition that depressions, which are formed due to the under layer 1 and the intermediate layer 2, are sufficiently filled using the first ink composition.

It is possible for the control section 70 described above to execute switching between the first mass mode and the second mass mode in the ink jet recording apparatus which is used in the ink jet recording method according to the present embodiment. In the image forming process, it is possible to obtain the first image which is provided with desired metallic gloss due to the desired mode being selected and executed.

The first mass mode is a mode where the mass of the first ink composition, which is used in order to form the first image, applied per unit of area exceeds 80% and is equal to or less than 200% in a case where the mass of the second ink composition, which is used in order to form the intermediate layer, applied per unit of area is 100%. Due to this, it is possible to record an image which has mirror surface gloss (shine). Here, there are cases where it is difficult to obtain a filling effect using the intermediate layer and the under layer and it is not possible to form a precise pattern when the mass of the first ink composition exceeds 200%.

In the first mass mode, the mass of the first ink composition, which is used in order to form the first image, applied per unit of area is preferably equal to or more than 2.5 $g/m^2$ and equal to or less than 120 $g/m^2$ and is more preferably equal to or more than 4 $g/m^2$ and equal to or less than 80 $g/m^2$. Due to this, it is easy to express mirror surface gloss.

The second mass mode is an example of the second mode where the mass of the first ink composition, which is used in order to form the first image, applied per unit of area is equal to or more than 10% and is equal to or less than 80% in a case where the mass of the second ink composition, which is used in order to form the intermediate layer, applied per unit of area is 100%. Due to this, it is possible to record an image which has sheen (luster). Here, there are cases where it is difficult to obtain sheen when the mass of the first ink composition is less than 10%.

In the second mass mode, it is possible for the mass of the first ink composition, which is used in order to form the first image, applied per unit of area to be, for example, equal to or more than 0.3 $g/m^2$ and equal to or less than 45 $g/m^2$, and the mass of the first ink composition applied per unit of area is more preferably equal to or more than 1 $g/m^2$ and equal to or less than 32 $g/m^2$ and is even more preferably equal to or more than 4 $g/m^2$ and equal to or less than 25 $g/m^2$.

Here, in a case where the intermediate layer is formed from the plurality of unit layers, "the mass of the second ink composition, which is used in order to form the intermediate layer, applied per unit of area" in the first mass mode and the second mass mode is based on "the mass of the second ink composition, which is used in order to form the unit layer which is formed last (also referred to as the last layer), applied per unit of area" out of the plurality of unit layers which configure the intermediate layer.

The image forming process may further include forming a second image by applying the first ink composition to a region where the intermediate layer is not formed. In detail, it is possible to form the second image on the front surface of the recording medium where the under layer is not formed and the front surface of the under layer where the intermediate layer is not formed. Due to this, it is possible to express embossing using the height difference between the first image and the second image.

The ink jet recording method according to the present embodiment may be further provided with a third irradiating process. The third irradiating process is a process for irradiating active energy rays onto the first image after the image forming process and is performed using, for example, the first light source described above. Due to this, it is possible to cure liquid droplets of the first ink composition which configures the first image.

It is possible for the control section 70 described above to execute switching between the first irradiating mode and the second irradiating mode in the ink jet recording apparatus which is used in the ink jet recording method according to the present embodiment. In the third irradiating process, it is possible to obtain the first image which is provided with desired metallic gloss due to the desired mode being selected and executed.

The first irradiating mode is a mode where active energy rays are irradiated within one second (preferably equal to or more than 0.001 seconds and equal to or less than 1 second, more preferably equal to or more than 0.005 seconds and equal to or less than 0.8 seconds, and even more preferably equal to or more than 0.008 seconds and equal to or less than 0.5 seconds) since liquid droplets of the first ink composition which forms the first image land on the intermediate layer. When active energy rays are irradiated within one second, it is difficult for liquid droplets of the first ink composition to flow into depressions which are formed on the front surface of the intermediate layer and liquid droplets of the first ink composition are cured without any changes so as to have graininess. As a result, there are times when the first image is provided with a color tone which is a mat tone, which has little gloss, where light is randomly reflected.

The second irradiating mode is a mode where active energy rays are irradiated after one second elapses (preferably after 1 second elapses and within 20 seconds and more preferably when the time which elapses is equal to or more than 2 seconds and equal to or less than 10 seconds) since liquid droplets of the first ink composition which forms the first image land on the intermediate layer. When active energy rays are irradiated after one second elapses, it is preferable due to a feature where it is possible to obtain the first image which has superior metallic gloss since it is easy for liquid droplets of the first ink composition to flow into depressions which are formed on the front surface of the intermediate layer due to sufficient wetting and spreading. In particular, the first image which has superior mirror surface gloss is obtained when executing the second irradiating mode and the first mass mode described above in combination in the image forming process. In addition, the second image which has superior sheen is obtained when executing the second irradiating mode and the second mass mode described above in combination.

2. Active Energy Ray Curable Ink Compositions

The first ink composition and the second ink composition which are used in the ink jet recording method described above are both so-called active energy ray curable ink compositions which are cured by irradiating of active energy rays. The first ink composition and the second ink composition will be described below. Here, as the active energy rays, there are examples of infrared rays, ultraviolet rays, X rays, electron rays, and the like, but ultraviolet rays or electron rays are preferable.

2.1. First Ink Composition

The first ink composition is an active energy ray curable ink composition which are used in the under layer forming process and the image forming process in the ink jet recording method described above. Components which are included in the first ink composition and components which can be included the first ink composition will be described below.

2.1.1. Metallic Pigment

As the metallic pigment, there are examples of an alloy with one type or two or more types which are selected from a group consisting of, for example, aluminum, silver, gold, platinum, nickel, chromium, tin, zinc, indium, titanium, and copper.

The metallic pigment may be coated using a coating film in order to suppress corrosion or the like. The coating film is preferably a film including an inorganic oxide which is formed using alkoxysilane (such as tetraethoxysilane), polysilazane, or the like, which have silicon atoms in their structures or a film which is obtained using a fluorine-based compound (for example, fluorine-based phosphonic acid, fluorine-based carboxylic acid, fluorine-based sulfonic acid, and the salts thereof).

The method for forming the coating film is not particularly limited, and it is possible to utilize the description in, for example, US Patent Publication No. 2010/0256284, US Patent Publication No. 2010/0256283, and the like.

The shape of the metallic pigment may be any shape such as a spherical shape, a spindle shape, a needle shape, or the like, but a plate fragment shape is preferable. It is possible to record an image which has superior metallic gloss since light reflectivity is enhanced in a case where the shape of the metallic pigment is a plate fragment shape.

In the present invention, the plate fragment shape refers to a shape where an area when viewed from a predetermined angle (when viewed in a planar view) is larger than an area when viewed from an angle which is orthogonal to this viewing direction, and in particular, a ratio ($S_1/S_0$) of an area $S_1$ ($\mu m^2$) when viewed from a direction which maximizes the projection area (when viewed in a planar view) with regard to an area $S_0$ ($\mu m^2$) when viewed from a direction which maximizes an area when viewed from an angle which is orthogonal to this viewing direction is preferably equal to or more than 2, is more preferably equal to or more than 5, and is particularly preferably equal to or more than 8. As this value, it is possible to perform viewing of, for example, ten arbitrary particles and adopt an average value which is a value which is calculated with regard to these particles.

The metallic pigment preferably has an average particle diameter of 0.25 μm to 3 μm and more preferably has an average particle diameter of 0.5 μm to 1.5 μm. In addition, the metallic pigment preferably has an average thickness of 1 nm to 100 nm and more preferably has an average thickness of 10 nm to 70 nm. It is possible to record an image which has superior coating film smoothness and superior metallic gloss by the average particle diameter and the average thickness of the metallic pigment being in the ranges described above. In addition, it is possible to productively manufacture a pigment dispersion liquid and it is also possible to prevent the metallic pigment from unintentionally changing shape when manufacturing the ink composition.

The average particle diameter is represented by a 50% average particle diameter (R50) which is an equivalent circle diameter which is determined from an area of a projection image of the metallic pigment which is obtained using a particle image analysis apparatus. "Equivalent circle diameter" is a diameter of an equivalent circle when it is assumed that the circle has the same area as the area of the projection image of the metallic pigment which is obtained using a particle image analysis apparatus. In a case where the projection image of the metallic pigment is, for example, a polygonal shape, the diameter of the equivalent circle, which is obtained by converting the projection image into a circle, is referred to as the equivalent circle diameter of the metallic pigment.

It is possible to measure the area and the equivalent circle diameter of the projection image of the metallic pigment using a particle image analysis apparatus. As the particle image analysis apparatus, there are examples of, for example, flow type particle image analysis apparatuses FPIA-2100, FPIA-3000, FPIA-3000S (all of the above manufactured by Sysmex Corp.), and the like. Here, the average particle diameter of the equivalent circle diameter is a particle diameter which is a numerical reference. In addition, as a method for measuring in a case where FPIA-3000 or FPIA-3000S is used, there is an example of a method where a high-magnification imaging unit is used and measuring is carried out using an HPF measuring mode.

Here, the average thickness is where a side surface image of the metallic pigment is imaged using a transmission electron microscope (a TEM) or a scanning electron microscope (a SEM), the thicknesses of the metallic pigments in ten cases is determined, and the thicknesses are averaged. As the transmission electron microscope (the TEM), there is the example of a model "JEM-2000EX" manufactured by JEOL Co., Ltd. and the like, and as the scanning electron microscope, there is the example of the model "S-4700" manufactured by Hitachi High-Technologies Corp. and the like.

The content of the metallic pigment is preferably equal to or more than 0.1 mass % and equal to or less than 5.0 mass % and more preferably equal to or more than 0.1 mass % and equal to or less than 3.0 mass % with regard to the overall mass (100 mass %) of the first ink composition. Due to this, there are cases where it is possible to improve metallic gloss.

2.1.2. Polymerizable Compound

It is preferable that the first ink composition contain a polymerizable compound. The polymerizable compound is provided with a property where ink is cured by polymerizing due to irradiating of active energy rays independently or with the actions of a photopolymerization initiator which will be described later. Due to this, it is possible to favorably cure the under layer and the first image.

The polymerizable compound is in liquid form. Due to this, since the usage amount of the liquid component, which is removed (evaporated) in an ink jet recording process, is reduced or it is not necessary to use any liquid component, particularly superior productivity is possible since it is not necessary to provide a process for removing a liquid component. In addition, it is possible to suppress generating of problems with volatile organic compounds (VOC) since it is not necessary to use an organic solvent.

It is sufficient if a component which is polymerized due to active energy rays (in particular ultraviolet rays) being irradiated is used as the polymerizable compound, and it is possible to use, for example, various types of monomers, various types of oligomers (including dimers, trimers, and the like), and the like. Even among these components, it is preferable to include at least a monomer component as the polymerizable compound. Compared to oligomer compounds or the like, monomers are typically advantageous in terms of ink composition with particularly superior discharge stability since monomers are components which have low viscosity.

In particular, it is preferable to include a monomer which has an alicyclic structure as the polymerizable compound. Due to this, particularly superior adhesiveness of the layer (image) which is recorded is possible and it is easier to control the desired shape of the liquid droplets.

As the monomer which has an alicyclic structure, there are examples of, for example, tris(2-(meth)acryloyloxyethyl) isocyanurate, dicyclopentenyloxyethyl (meth)acrylate, adamantyl (meth)acrylate, γ-butyrolactone (meth)acrylate, N-vinylcaprolactam, N-vinylpyrrolidone, pentamethylpiperidyl (meth)acrylate, tetramethylpiperidyl (meth)acrylate, 2-methyl-2-adamantyl (meth)acrylate, 2-ethyl-2-adamantyl (meth)acrylate, mevalonate lactone (meth)acrylate, dimethyloltricyclodecane (meth)acrylate, dimethyloldicyclopentane di(meth)acrylate, dicyclopentenyl (meth)acrylate, dicyclopentanyl (meth)acrylate, isobornyl (meth)acrylate, cyclohexyl (meth)acrylate, (meth)acryloylmorpholine, tetrahydrofurfuryl (meth)acrylate, phenylglycidylether (meth)acrylate, EO modified hydrogenated bisphenol-A di(meth)acrylate, di(meth)acrylated isocyanurate, tri(meth)acrylated isocyanurate, and the like, but it is preferable that the monomer include one type or two or more types which are selected from a group consisting of tris(2-acryloyloxyethyl) isocyanurate, dicyclopentenyloxyethyl acrylate, adamantyl acrylate, γ-butyrolactone acrylate, N-vinylcaprolactam, N-vinylpyrrolidone, pentamethylpiperidyl acrylate, tetramethylpiperidyl acrylate, 2-methyl-2-adamantyl acrylate, 2-ethyl-2-adamantyl acrylate, cyclohexane spiro-2-(1,3-dioxolan-4-yl)methyl acrylate, (2-methyl-2-ethyl-1,3 dioxolan-4-yl) methyl acrylate, mevalonate lactone acrylate, dimethylol tricyclodecane diacrylate, dimethylol dicyclopentane diacrylate, dicyclopentenyl acrylate, dicyclopentanyl acrylate, isobornyl acrylate, cyclohexyl acrylate, acryloylmorpholine, and tetrahydrofurfuryl acrylate. Due to this, even more superior adhesiveness of the layer (the image) which is formed is possible and it is easier to control the desired shape of the liquid droplets. In addition, it is possible for the first ink composition to have even more superior stability during storage and discharge stability and it is possible to improve the metallic gloss of the layer (the image) which is formed.

The content of the monomer which has an alicyclic structure is preferably equal to or more than 40 mass % and equal to or less than 90 mass %, is more preferably equal to or more than 50 mass % and equal to or less than 88 mass %, and is even more preferably equal to or more than 55 mass % and equal to or less than 85 mass % with regard to the overall mass of the first ink composition. Here, the first ink composition may include two or more types of compounds as the monomer which has an alicyclic structure. In this case, it is preferable that the sum of the content of the monomers be a value which is within the range described above.

The constituent atomic number of the alicyclic structure, which is formed using covalent bonds, in the monomer which has an alicyclic structure is preferably five or more and is more preferably six or more. Due to this, it is possible for the ink compositions to have particularly superior stability during storage.

It is preferable that the first ink composition include a mono-functional monomer (a mono-functional monomer with heterocyclic rings which do not exhibit aromaticity) which includes a heteroatom in the alicyclic structure as the monomer which has an alicyclic structure. Due to this, dispersion stability of the metallic pigment is improved and particularly superior discharge stability is obtained over a long period of time. As the mono-functional monomer, there are examples of, for example, tris(2-(meth)acryloyloxyethyl) isocyanurate, γ-butyrolactone (meth)acrylate, N-vinyl caprolactam, N-vinyl pyrrolidone, pentamethylpiperidyl (meth)acrylate, tetramethylpiperidyl (meth)acrylate, mevalonate lactone (meth)acrylate, (meth)acryloyl morpholine, tetrahydrofurfuryl (meth)acrylate, and the like.

The content of the mono-functional monomer which includes a heteroatom in the alicyclic structure is preferably equal to or more than 10 mass % and equal to or less than 80 mass % and is more preferably equal to or more than 15 mass % and equal to or less than 75 mass % with regard to the overall mass of the first ink composition. Due to this, it is possible to more effectively suppress shrinkage during curing. Here, the first ink composition may include two or more types of compounds as the mono-functional monomer which includes a heteroatom in the alicyclic structure. In this case, it is preferable that the sum of the content be a value which is within the range described above.

In particular, the polymerizable compound may include a monomer which does not have an alicyclic structure. As the monomer which does not have an alicyclic structure, there are examples of, for example, phenoxyethyl (meth)acrylate, benzyl (meth)acrylate, (meth) acrylate 2-(2-vinyloxyethoxyl)ethyl, dipropylene glycol di(meth)acrylate, tripropylene glycol di(meth)acrylate, 2-hydroxy 3-phenoxypropyl (meth)acrylate, 4-hydroxybutyl (meth)acrylate lauryl (meth) acrylate, 2-methoxyethyl (meth)acrylate, isooctyl (meth) acrylate, stearyl (meth)acrylate, 2-ethoxyethyl (meth)acrylate, benzyl (meth)acrylate, 1H,1H,5H-octafluoropentyl (meth)acrylate, 2-hydroxyethyl (meth)acrylate, 2-hydroxypropyl (meth)acrylate, isobutyl (meth)acrylate, t-butyl (meth)acrylate, ethyl carbitol (meth)acrylate, 2,2,2-trifluoroethyl (meth)acrylate, 2,2,3,3-tetrafluoropropyl (meth) acrylate, methoxytriethylene glycol (meth)acrylate, PO modified nonylphenol (meth)acrylate, EO modified nonylphenol (meth)acrylate, EO modified 2-ethylhexyl (meth) acrylate, phenoxy diethylene glycol (meth)acrylate, EO modified phenol (meth)acrylate, EO modified cresol (meth) acrylate, methoxy polyethylene glycol (meth)acrylate, dipropylene glycol (meth)acrylate, 2-n-butyl 2-ethyl 1,3-propanediol di(meth)acrylate, tetraethylene glycol di(meth) acrylate, 1,9-nonanediol di(meth)acrylate, 1,4-butanediol di(meth)acrylate, bisphenol A EO modified di(meth)acrylate, 1,6-hexanediol di(meth)acrylate, polyethylene glycol 200 di(meth)acrylate, polyethylene glycol 300 di(meth) acrylate, neopentyl glycol hydroxypivalate di(meth)acrylate, 2-ethyl 2-butyl propanediol di(meth)acrylate, polyethylene glycol 400 di(meth)acrylate, polyethylene glycol 600 di(meth)acrylate, polypropylene glycol di(meth)acrylate, bisphenol A EO modified di(meth)acrylate, PO modified bisphenol A di(meth)acrylate, trimethylolpropane tri(meth) acrylate, pentaerythritol tri(meth)acrylate, trimethylolpropane EO-modified tri(meth)acrylate, glycerol PO-added tri (meth)acrylate, tris(meth)acryloyloxyethyl phosphate, pentaerythritol tetra(meth)acrylate, PO modified trimethylolpropane tri(meth)acrylate, 2-(meth)acryloyloxyethyl phthalate, 3-(meth)acryloyloxypropyl acrylate, w-carboxy (meth)acryloyloxyethyl phthalate, ditrimethylolpropane tetra(meth)acrylate, dipentaerythritol penta/hexa(meth)acrylate, dipentaerythritol hexa(meth)acrylate, and the like, but it is preferable that the monomer include one type or two or more types which are selected from a group consisting of phenoxyethyl acrylate, benzyl acrylate, acrylate 2-(2-vinyloxyethoxyl)ethyl, dipropylene glycol diacrylate, tripropylene glycol diacrylate, 2-hydroxy 3-phenoxypropyl acrylate, and 4-hydroxybutyl acrylate. Due to the monomer which does not have an alicyclic structure being included, it is possible for the ink composition to have superior stability during storage and discharge stability, particularly superior reactivity after discharging using the ink jet system, and particularly superior productivity.

The content of monomers other than the monomer which includes an alicyclic structure is preferably equal to or more than 5 mass % and equal to or less than 50 mass % and is more preferably equal to or more than 10 mass % and equal to or less than 40 mass % with regard to the overall mass of the first ink composition. Due to this, curing speed of the first ink composition and flexibility of the layer (the image) are particularly superior, and adjustment of the rate of shrinkage or the like during curing is even easier. Here, the first ink composition may include two or more types of compounds as the monomer which does not have an alicyclic structure. In this case, it is preferable that the sum of the content be a value which is within the range described above.

Other than the monomer, the first ink composition may include an oligomer (including dimers, trimers, and the like), a prepolymer, or the like as the polymerizable compound. It is possible to use, for example, an oligomer or prepolymer where monomers such as described above are the composition component as the oligomer or the prepolymer. It is particularly preferable that the first ink composition include a multi-functional oligomer. Due to this, it is possible for the first ink composition to have particularly superior stability during storage. It is preferable to use a urethane oligomer where the repeating structure is urethane, an epoxy oligomer where the repeating structure is epoxy, or the like as the oligomer.

The content of the polymerizable compound is preferably equal to or more than 70 mass % and equal to or less than 99 mass % and is more preferably equal to or more than 80 mass % and equal to or less than 98 mass % with regard to the overall mass of the first ink composition. Due to this, it is possible for the first ink composition to have even more superior stability during storage, discharge stability, and curability. Here, the first ink composition may include two or more types of compounds as the polymerizable compound. In this case, it is preferable that the sum of the content of the compounds be a value which is within the range described above.

2.1.3. Photopolymerization Initiator

The first ink composition according to the present embodiment may contain a photopolymerization initiator. The photopolymerization initiator is not particularly limited as long as an active species such as a radical or a cation is generated due to active energy rays being irradiated and a polymerization reaction is initiated in the polymerizable compound. It is possible to use a photo-radical polymerization initiator or a photo-cationic polymerization initiator as the photopolymerization initiator, but it is preferable to use the photo-radical polymerization initiator. In a case where the photopolymerization initiator is used, it is preferable that the photopolymerization initiator have an absorption peak in an ultraviolet region.

As the photo-radical polymerization initiator, there are examples of, for example, aromatic ketones, acyl phosphine oxide compounds, aromatic onium salt compounds, organic peroxides, thio compounds (thioxanthone compounds, compounds which contain a thiophenyl group, and the like), hexaarylbiimidazole compounds, ketoxime ester compounds, borate compounds, azinium compounds, metallocene compounds, active ester compounds, compounds with a carbon-halogen bond, alkyl amine compounds, and the like.

The content of the photopolymerization initiator is preferably equal to or more than 0.5 mass % and equal to or less than 10 mass % with regard to the overall mass of the first ink composition. When the content of the photopolymerization initiator is within the range described above, the curing speed is sufficiently fast and there is hardly any of the photopolymerization initiator liquid remaining or any coloring which is derived from the photopolymerization initiator.

2.1.4. Other Components

The first ink composition may include components other than those described above (other components). As the other components, there are examples of, for example, dispersing agents, slip agents (leveling agents), polymerization accelerators, polymerization inhibitors, penetration promoting agents, wetting agents (moisturizing agents), fixing agents, anti-molding agents, preserving agents, antioxidants, chelating agents, thickeners, sensitizing agents (sensitizing dyes), and the like.

2.2. Second Ink Composition

The second ink composition is an active energy ray curable ink composition which is used in the intermediate layer forming process in the ink jet recording method described above. Components which are included in the second ink composition and components which can be included in the second ink composition will be described below.

2.2.1. Colorant

The second ink composition may contain a colorant. As the colorant, there are examples of color colorant such as a dye and a pigment (colorant excluding luminescent pigments), metallic pigments described above, and the like. In the present invention, there are cases where an ink composition which contains a color colorant such as a dye and a pigment is referred to as a color ink composition. When the second ink composition is a color ink composition, it is advantageous in that it is possible to form an embossed image which has a metallic color and the breadth of design expression is wider.

Among dyes and pigments which are used as the color colorant, it is preferable to use a pigment from the viewpoint of light resistance and the like. The color colorant may be used individually with one single type or may be used as a mixture of two or more types.

As an organic pigment among the pigments, there are examples of, for example, azo pigments (for example, azo lake pigments, insoluble azo pigments, condensed azo pigments, chelate azo pigments, and the like), polycyclic pigments (phthalocyanine pigments, perylene and perylene pigments, anthraquinone pigments, quinacridone pigments, dioxazine pigments, thioindigo pigments, isoindolinone pigments, quinophthalone pigments, and the like), dye lakes (for example, basic dye lakes, acidic dye lakes, and the like), nitro pigments, nitroso pigments, aniline black, daylight fluorescent pigments, and the like. In addition, as the inorganic pigment among the pigments, there are examples of carbon black, titanium dioxide, silica, and the like.

It is possible to appropriately set the content as desired in a case where the color colorant is contained and the content is not particularly limited, but the content of the color colorant is normally equal to or more than 0.1 mass % and equal to or less than 10 mass % with regard to the overall mass (100 mass %) of the second ink composition.

On the other hand, the second ink composition may not contain the colorant substantially and may be a so-called clear ink composition. The clear ink composition forms a transparent or semi-transparent layer since the clear ink composition does not contain colorant substantially. When the second ink composition is a clear ink composition, it is possible to express superior embossing where it is possible to even more remarkably sense the concavities and convexities within the image or concavities and convexities between the images and the front surface of the recording medium.

Here, "does not contain A substantially" has the meaning to the extent of A not intentionally being added when ink is manufactured, and it is not a problem if a small amount of A, which is unavoidably mixed or generated during manufacture or during storage of ink, is included. As a specific example of "not containing substantially", there is, for example, not containing equal to or more than 1.0 mass %, preferably not containing equal to or more than 0.5 mass %, more preferably not containing equal to or more than 0.1 mass %, even more preferably not containing equal to or more than 0.05 mass %, and particularly preferably not containing equal to or more than 0.01 mass %.

In addition, the second ink composition according to the present embodiment may be an ink composition which contains a metallic pigment in the same manner as the first ink composition. In this case, it is not possible to obtain the effects described above which are generated in a case where the second ink composition is a color ink composition or a clear ink composition, but it is possible for the function to be exhibited as the intermediate layer described above. It is possible to use the same metallic pigment, which is described in the first ink composition described above, as the metallic pigment.

2.2.2. Polymerizable Compound

It is preferable that the second ink composition contain a polymerizable compound. Since the functions, specific examples, preferable content, and the like of the polymerizable compound are the same as the polymerizable compound in the first ink composition, description thereof is omitted.

2.2.3. Photopolymerization Initiator

The second ink composition may contain a photopolymerization initiator. Since the functions, specific examples, preferable content, and the like of the photopolymerization initiator are the same as the photopolymerization initiator in the first ink composition, description thereof is omitted.

2.2.4. Other Components

The second ink composition may include components other than those described above (other components). As the other components, there are examples of, for example, dispersing agents, slip agents (leveling agents), polymerization accelerators, polymerization inhibitors, penetration promoting agents, wetting agents (moisturizing agents), fixing agents, anti-molding agents, preserving agents, antioxidants, chelating agents, thickeners, sensitizing agents (sensitizing dyes), and the like.

2.3. Properties of Ink Composition

The viscosity of both the first ink composition and the second ink composition at 20° C. is preferably equal to or more than 4 mPa·s and equal to or less than 40 mPa·s and more preferably equal to or more than 6 mPa·s and equal to or less than 30 mPa·s. Due to this, it is possible for the first ink composition and the second ink composition to have superior discharge stability. Here, it is possible to measure the viscosity of the first ink composition and the second ink composition using a vibrator viscometer which complies with the MS Z8809 standard.

3. Examples

The present invention is described below in more detail using examples, but the present invention is not limited in any way by the examples.

3.1. Preparation of First Ink Composition

First, a polyethylene terephthalate film (where surface roughness Ra is equal to or less than 0.02 μm) where the front surface is smooth is prepared.

Next, the entirety of one surface of the film is coated with silicone oil. A film, which is configured from aluminum (hereafter simply referred to as an "aluminum film") using a vapor disposition system, is formed on the surface side where the silicone oil is coated.

Next, the film where the aluminum film is formed is introduced into diethylene glycol diethyl ether, and the aluminum film is peeled away from the film and pulverized by being irradiated with ultrasonic waves. Next, a dispersion liquid of aluminum particles (base particles) in flake form is obtained due to being introduced into a homogenizer and being subjected to pulverizing treatment for approximately eight hours. The concentration of the aluminum particles in the dispersion liquid is 10 mass %.

Next, 100 parts by mass of diethylene glycol diethyl ether is added with regard to 100 parts by mass of the dispersion liquid which includes aluminum particles which are obtained in the manner described above, 50 parts by mass of 2-(perfluorohexyl) ethylphosphonic acid is added with regard to 100 parts by mass of the aluminum particles after the concentration of the aluminum particles is adjusted to 5 mass %, and surface treatment is performed on the aluminum particles while ultrasonic waves are irradiated for three hours at a liquid temperature of 55° C. After that, the aluminum particles are subjected to centrifugal sedimentation in a centrifugal separator (at 10000 rpm for 30 minutes) and the supernatant is discarded, and the aluminum particles are re-dispersed by adding a propylene glycol aqueous solution to which a fluorine-based surfactant (product name of "Megaface F-553" manufactured by DIC Corp.) is added and are subjected to heat treatment for six days at 70° C. Next, the aluminum particles are subjected to centrifugal sedimentation in a centrifugal separator (at 10000 rpm for 30 minutes) and the supernatant is discarded, and a 2-methyl 2,4-pentanediol aqueous solution is added to the aluminum particles and the aluminum particles are cleaned by further irradiating with ultrasonic waves. By doing this, aluminum particles where surface treatment is carried out are obtained. The average particle diameter of the aluminum particles which are obtained is 0.8 μm and the average thickness is 10 nm.

Next, the first ink composition is obtained by agitating and mixing aluminum particles (the metallic pigment) which are obtained as described above, phenoxyethyl acrylate (abbreviated to "PEA" in the table), tripropylene glycol diacrylate (abbreviated to "TPGDA" in the table), dipropylene glycol diacrylate (abbreviated to "DPGDA" in the table), 2-hydroxy 3-phenoxy propyl acrylate (abbreviated to "HPPA" in the table), N-vinylcaprolactam (abbreviated to "VC" in the table), and dimethyloltricyclodecane diacrylate (abbreviated to "DMTCDDA" in the table) which are the polymerizable compound, Irgacure 819 (product name, manufactured by Ciba Japan K.K.), Speedcure TPO (product name, manufactured by ACETO Corp.), and Speedcure DETX (product name, manufactured by Lambson Ltd.) which are the photopolymerization initiator as per the mixing ratios in table 1.

3.2. Preparation of Second Ink Composition

The second ink composition which is a clear ink composition is obtained by mixing and agitating each component as per the mixing ratios in table 1.

TABLE 1

| | | First Ink Composition | Second Ink Composition |
|---|---|---|---|
| Metal Pigment | aluminum particles | 1 | |
| Polymerization Initiator | Irgacure 819 | 4 | 4 |
| | Speedcure TPO | 4 | 4 |
| | Speedcure DETX | 2 | 2 |
| Polymerizable Compound | TPGDA | 35 | 35 |
| | DPGDA | 2 | 2 |
| | VC | 5.5 | 5.5 |
| | DMTCDDA | 4 | 4 |
| | HPPA | 2.2 | 2.2 |
| | PEA | remaining amount | remaining amount |
| Total (mass %) | | 100 | 100 |

3.3. Evaluation Test

Evaluation samples which are used in each evaluation test are manufactured as follows. First, the first ink composition and the second ink composition, which are obtained as described above, are filled into ink cartridges for an ink jet printer PX-G930 (product name, Seiko Epson Corp.) and are in a state where supplying to the recording head of the printer is possible. Here, light sources (product name of "FireFly UV Light System" which is manufactured by Phoseon Technology Inc.) are used at the ends on both sides of the head in the main scanning direction in the printer described above to be attached such that the gap between the recording medium and the light sources is 1 mm.

Then, an evaluation sample (recording material), where an image is formed on the recording medium, is obtained by performing in order of the under layer forming process for forming the under layer by adhering liquid droplets of the first ink composition which are discharged from the recording head onto the recording medium, the first irradiating process for irradiating ultraviolet rays from the light source with regard to the under layer at a designated timing, the intermediate layer forming process for forming the intermediate layer by adhering the second ink composition which is discharged from the recording head onto the under layer, the second irradiating process for irradiating ultraviolet rays from the light source with regard to the under layer at a designated timing, the image forming process for forming the first image by adhering liquid droplets of the first ink composition which are discharged from the recording head onto the intermediate layer, and the third irradiating process for irradiating ultraviolet rays from the light source with regard to the first image at a designated timing.

Four solid patterns of 5 cm×5 cm are printed at intervals of 0.5 mm as an image pattern. In addition, printing of each layer (image) is performed with an image resolution of 720 dpi lengthwise×720 dpi widthwise and with the transport speed of the recording medium as 350 mm/sec.

The mass of the ink composition, which is used when forming the layers (the images) for each of the under layer, the intermediate layer, and the first image, applied per unit of area is shown in table 2. In addition, the timing for irradiating of the ultraviolet rays (the period of time from the ink droplets landing to irradiating with ultraviolet rays) when forming the layers (the images) for each of the under layer, the intermediate layer, and the first image is shown in table 2.

PC (polycarbonate with a product name of "IUPILON FE-2000" which is manufactured by Mitsubishi Engineering Plastics Corp.), PET (polyethylene terephthalate sheets with a product name of "FT3" which is manufactured by Teijin DuPont Films Japan Ltd.), and glass (glass substrates with a product name "NA35" which is manufactured by Nippon Sheet Glass Co., Ltd.) are used as the recording medium.

3.3.1. Metallic Gloss Evaluation Tests

It is visually determined whether a portion where the image is formed in the evaluation sample is equivalent to any of a mirror surface gloss, a sheen finish (random reflection), or a mat finish (low gloss).

3.3.2. Concavity and Convexity (Embossing) Evaluation

Evaluation of concavities and convexities (embossing) is performed by measuring the height difference between the front surface of the recording medium where the under layer, the intermediate layer, and the first image are not formed and the front surface of the first image using a level difference measuring apparatus (SURFTEST SV-600 manufactured by Mitsutoyo Corp.).

A: Height difference equal to or more than 100 μm

B: Height difference equal to or more than 50 μm and less than 100 μm

C: Height difference less than 50 μm

3.3.3. Evaluation of Precision

Precision of the portion where the image is formed in the evaluation sample is determined by confirming the presence or absence of bleeding or irregularities at contour portions.

Precision: bleeding and irregularities are not confirmed

No precision: bleeding and irregularities are confirmed

3.4. Evaluation Results

The results of the evaluation tests described above are shown in table 2.

It is shown that it is possible to form an embossed image which has various types of metallic gloss by adopting printing conditions where the under layer, the intermediate layer, and the first image are layered in order (refer to the examples). Here, ink droplets which configure the under layer excessively wet and spread and the image which is recorded is poor in terms of precision in condition 8 in the examples since the timing for irradiating ultraviolet rays onto the under layer is delayed.

On the other hand, it is understood that it is not possible to express embossing and it is not possible to express various types of metallic gloss when one of the under layer or the intermediate layer is not formed (refer to the comparative examples). In particular, it is understood that it is not possible to express sheen and the breadth of the expression of metallic gloss is small even though it is possible to express mirror surface gloss in a case where printing conditions where the under layer is not formed are adopted as in condition 14 in the comparative examples.

The present invention is not limited to the embodiments described above and various modifications are possible. For example, the present invention includes configurations which are the same in practice as the configurations described in the embodiments (for example, configurations which have the same functions, method, and results or configurations which have the same object and results). In addition, the present invention includes configurations where non-essential portions of the configuration described in the embodiments are replaced. In addition, the present invention includes configurations which accomplish the same action effects and configurations where it is possible to realize the same object as the configuration described in the embodiments. In addition, the present invention includes configurations where known techniques are added to the configurations which are described in the embodiments.

GENERAL INTERPRETATION OF TERMS

In understanding the scope of the present invention, the term "comprising" and its derivatives, as used herein, are intended to be open ended terms that specify the presence of

TABLE 2

| | | | Mass Applied per Unit Area (g/m²) | | | Ratio of First Image Applied | Timing for Irradiating Ultraviolet Rays (Seconds) | | | Evaluation Tests | | |
|---|---|---|---|---|---|---|---|---|---|---|---|---|
| | Printing Conditions | Recording Medium | First Image | Intermediate Layer | Under Layer | with regard to Intermediate Layer (%) | First Image | Intermediate Layer | Under Layer | Metal Gloss | Convexities and Convexities | Precision |
| Examples | Condition 1 | PC | 20 | 20 | 10 | 100 | 3 | 0.5 | 0.5 | Mirror Surface Finish | A | Yes |
| | Condition 2 | PC | 10 | 20 | 10 | 50 | 3 | 2 | 0.5 | Sheen Finish | A | Yes |
| | Condition 3 | PC | 20 | 20 | 10 | 100 | 0.5 | 0.5 | 0.5 | Mat Finish | A | Yes |
| | Condition 4 | PC | 10 | 20 | 10 | 50 | 0.5 | 0.5 | 0.5 | Mat Finish | A | Yes |
| | Condition 5 | PC | 20 | 30 | 10 | 67 | 3 | 2 | 0.5 | Sheen Finish | A | Yes |
| | Condition 6 | PC | 40 | 30 | 10 | 133 | 3 | 0.5 | 0.5 | Mirror Surface Finish | A | Yes |
| | Condition 7 | PC | 18 | 10 | 10 | 180 | 3 | 0.5 | 0.5 | Mirror Surface Finish | B | Yes |
| | Condition 8 | PC | 15 | 20 | 10 | 75 | 0.5 | 0.5 | 2 | Mat Finish | A | No |
| | Condition 9 | PET | 20 | 20 | 10 | 100 | 3 | 0.5 | 0.5 | Mirror Surface Finish | A | Yes |
| | Condition 10 | PET | 10 | 20 | 10 | 50 | 3 | 2 | 0.5 | SheenFinish | A | Yes |
| | Condition 11 | Glass | 20 | 20 | 10 | 100 | 3 | 0.5 | 0.5 | Mirror Surface Finish | A | Yes |
| | Condition 12 | Glass | 10 | 20 | 10 | 50 | 3 | 2 | 0.5 | Sheen Finish | A | Yes |
| Comparative Examples | Condition 13 | PC | 15 | 0 | 10 | — | 3 | — | 0.5 | Mirror Surface Finish | C | Yes |
| | Condition 14 | PC | 10 | 20 | 0 | 50 | 3 | 0.5 | — | Mirror Surface Finish | A | Yes |

the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An ink jet recording method comprising:

forming an under layer by applying an active energy ray curable first ink composition which contains a metallic pigment to a printing medium;

forming an intermediate layer by applying an active energy ray curable second ink composition to the under layer; and forming a first image by applying the first ink composition to the intermediate layer, a surface of the under layer and the intermediate layer remaining in a state of having convex regions and concave regions generated by adjusting a mass of ink composition applied per unit of area, a mass of the second ink composition applied per unit of area being larger than a mass of the first ink composition applied per unit of area.

2. The ink jet recording method according to claim 1, wherein the thickness of the intermediate layer is equal to or more than 50 μm and equal to or less than 300 μm.

3. The ink jet recording method according to claim 1, wherein the forming of the first image further includes forming a second image by applying the first ink composition to a region where the intermediate layer is not formed.

4. The ink jet recording method according to claim 1, wherein the mass of the second ink composition, which is used in order to form the intermediate layer, applied per unit of area is larger than the mass of the first ink composition, which is used in order to form the under layer, applied per unit of area.

5. The ink jet recording method according to claim 1, wherein the second ink composition is a color ink composition which contains a colorant or a clear ink composition which substantially does not contain a colorant.

6. The ink jet recording method according to claim 1, further comprising:

performing a first irradiating process to irradiate active energy rays onto the under layer before the forming of the intermediate layer; and performing a second irradiating process to irradiate active energy rays onto the intermediate layer before the forming of the first image, wherein active energy rays are irradiated within one second since liquid droplets of the first ink composition which forms the under layer land on the recording medium in the first irradiating process, and active energy rays are irradiated within one second since liquid droplets of the second ink composition which forms the intermediate layer land on the under layer in the second irradiating process.

7. The ink jet recording method according to claim 1, further comprising performing a third irradiating process to irradiate active energy rays onto the first image after the forming of the first image, wherein active energy rays are irradiated after one second elapses since liquid droplets of the first ink composition which forms the first image land on the intermediate layer in the third irradiating process.

8. The ink jet recording method according to claim 1, wherein the mass of the first ink composition, which is used in order to form the first image, applied per unit of area exceeds 80% and is equal to or less than 200% in a case where the mass of the second ink composition, which is used in order to form the intermediate layer, applied per unit of area is 100%.

9. The ink jet recording method according to claim 1, wherein the mass of the first ink composition, which is used in order to form the first image, applied per unit of area is equal to or more than 10% and equal to or less than 80% in a case where the mass of the second ink composition, which is used in order to form the intermediate layer, applied per unit of area is 100%.

10. The ink jet recording method according to claim 1, wherein a discharge amount of the ink composition per single droplet is adjusted such that a discharge amount of the first ink composition per single droplet is equal to or less than 20 ng, and a discharge amount of the second ink composition per single droplet is equal to or less than 20 ng.

11. The ink jet recording method according to claim 1, wherein the mass of the second ink composition applied per unit of area is more than one time and up to five times of the mass of the first ink composition applied per unit of area.

12. The ink jet recording method according to claim 1, wherein the mass of the first ink composition applied per unit of area is equal to or less than 20 $g/m^2$, and the mass of the second ink composition applied per unit of area is equal to or less than 60 $g/m^2$.

* * * * *